United States Patent [19]

Vance et al.

[11] Patent Number: 4,721,656

[45] Date of Patent: Jan. 26, 1988

[54] ELECTROPLATING ALUMINUM ALLOYS FROM ORGANIC SOLVENT BATHS AND ARTICLES COATED THEREWITH

[75] Inventors: Christopher J. Vance, Geneva; Thinh Nguyen, Onex Geneva, both of Switzerland

[73] Assignee: Eltech Systems Corporation, Boca Raton, Fla.

[21] Appl. No.: 879,233

[22] PCT Filed: Sep. 14, 1985

[86] PCT No.: PCT/EP85/00471

§ 371 Date: May 16, 1986

§ 102(e) Date: May 16, 1986

[87] PCT Pub. No.: WO86/01840

PCT Pub. Date: Mar. 27, 1986

[30] Foreign Application Priority Data

Sep. 17, 1984 [AT] Austria ..... 84810453.5

[51] Int. Cl.[4] ..... C25D 3/56

[52] U.S. Cl. ..... 428/650; 204/58.5; 420/434; 420/514; 420/525; 420/528; 420/531; 420/554

[58] Field of Search ..... 204/58.5; 428/650; 420/514, 525, 528, 531, 554, 434

[56] References Cited

U.S. PATENT DOCUMENTS

| | | | |
|---|---|---|---|
| 2,170,375 | 8/1939 | Mathers et al. | 204/58.5 |
| 3,268,421 | 8/1966 | McGraw | 204/58.5 X |
| 3,343,930 | 9/1967 | Borzillo et al. | 428/653 |
| 3,393,089 | 7/1968 | Borzillo et al. | 427/329 |
| 3,775,260 | 11/1973 | Capuano et al. | 204/14.1 |
| 4,071,415 | 1/1978 | Wong | 204/58.5 |
| 4,152,220 | 5/1979 | Wong | 204/58.5 |
| 4,287,009 | 9/1981 | Allegra et al. | 148/127 |

FOREIGN PATENT DOCUMENTS

| | | | |
|---|---|---|---|
| 694738 | 8/1940 | Fed. Rep. of Germany | 204/58.5 |
| 3107384 | 9/1982 | Fed. Rep. of Germany | 204/58.5 |

OTHER PUBLICATIONS

R. D. Blue et al., The Electrochemical Soc., Preprint 69-23, (1936).

"Structural Characteristics of Some Electrodeposited Aluminum-Manganese Alloys", Electrochemical Technology, vol. 4, No. 11-12, Nov./Dec. 1966, H. G. Read et al.

*Primary Examiner*—G. L. Kaplan

*Attorney, Agent, or Firm*—John J. Freer

[57] ABSTRACT

A coating for metallic faces comprising an alloy of aluminum with at least one of zinc, cadmium or manganese is proposed, whereby the alloy coating is applied onto the metal surface by means of electrodeposition using a non-aqueous electrolyte. The electrolyte comprises toluene as a solvent for chlorides of the alloy components. The coating may be used e.g. for corrosion protection.

5 Claims, No Drawings

ELECTROPLATING ALUMINUM ALLOYS FROM ORGANIC SOLVENT BATHS AND ARTICLES COATED THEREWITH

FIELD OF INVENTION

The invention relates to a coating for metallic substrates, the coating comprising an Al-alloy, as well as a method for producing this coating. The invention further relates to the use of this coating for protecting metallic surfaces e.g. against corrosion.

BACKGROUND ART

It is known from U.S. Pat. Nos. 3,343,930 and 3,393,089 to coat metallic surfaces with an alloy of zinc and aluminum for corrosion protection. The method according to which these alloys are coated onto the metallic surfaces comprises dipping the metal substrate into a molten bath of the respective alloys. The advantages of zinc-aluminum coatings compared to pure aluminum coatings or alloys of aluminum with e.g. refractory metals such as titanium, chromium or molybdenum is that zinc provides a higher galvanic protection to e.g. a steel substrate. Thus the steel surfaces which are coated with a zinc-aluminum alloy provide a better corrosion protection than pure aluminum or alloys of aluminum with refractory metals.

Even though the above two U.S. patents already disclose the use of zinc-aluminum alloys for improved galvanic corrosion protection, the proposed hot dipping process does not provide optimum coatings in respect of uniformity, optimal thickness and formability. In addition the high temperature process leads to the formation of brittle intermetallic phases at the coating-substrate interface and requires the addition of silicon to reduce this tendency and to improve the coating adhesion.

The U.S. Pat. No. 4,287,009 discloses an Al/Zn coating which is applied to the substrate by a hot dipping process, whereby the exact temperature during the dipping process and the cooling rate are controlled as to improve the structure of the coating. Compared to uncontrolled dipping processes it is claimed to reduce the grain size and therewith improve the performance of the coating. However, it is evident from the phase diagram of the Al/Zn system that no single phase solidification is obtainable since the area in the phase diagram which is designated as "$\alpha+L$" has to be crossed during the cooling period, which needs a certain amount of time, during which the composition of the liquid phase changes gradually because of the solidification of selected components. Therefore the solidification leads first to Al rich zones and then to Zn rich zones, thus creating at least a two phase coating. The grain sizes are coarse, being of the order of up to 50 microns. The only possibility to obtain a single phase solidification in this system would be to pass exactly through the eutectic point which is, however, only possible for a mixture of approximately 5% Al and 95% Zn. The shock cooling after complete solidification may decrease the grain size thereafter by interdiffusion, but does not lead to a real submicroscopic distribution, which is believed to yield the best performance for corrosion protection, since relatively large Al-rich zones tend to become passivated by the formation of a protective oxide layer. Consequently the zinc is subject to corrosion leaving a porous passivated Al structure which is less galvanically active and offers poorer corrosion protection to the substrate.

From U.S. Pat. No. 3,775,260 it is known to electroplate aluminum or e.g. an alloy of aluminum and zinc or cadmium onto a metallic substrate whereby the electrodeposition is carried out in a hydrous organic solvent comprising aluminum bromide. The second metal component of the desired alloy is introduced as a soluble alloy anode which gradually dissolves as the respective metal component is plated onto the cathode. However, there are several disadvantages in the use of the hydrous electrolyte. The reduction of protons will lead to a loss of cathodic current efficiency. In addition the proton reduction can lead to hydrogen embrittlement problems when high strength steels are coated. Moreover, this U.S. patent does not refer to any use of the coatings produced with the disclosed metals and no specific advantages of the obtained coatings in respect to other coating methods are discussed.

U.S. Pat. No. 2,170,375 discloses a method for electroplating aluminum or an alloy thereof with zinc, copper or cadmium onto a substrate of a dissimmilar metal in a non-aqueous bath comprising the reaction product of benzene or derivatives of benzene and alkyl or hydrogen halides. However, alkyl halides lead to the formation of alkylhalogenoaluminate species which are not cathodically stable. Consequently these species can be reduced during electrolysis leading to a decrease of current efficiency and chemical decomposition of the solvent system. Again no specific use of this method and no product which may be manufactured by this method is disclosed and no specific advantages of this plating method over other known coating procedures are discussed.

H. G. Read et al (ELECTROCHEMICAL TECHNOLOGY, Vol 4, No. 11-12, Nov/Dec. 1966) report electrolytic codeposition of aluminum and manganese in fused-salt baths to form bright coatings. Details are discussed relating to the optical aspects of these coatings depending on the concentration of manganese in the electrolyte and in the deposit. The coatings produced from this relatively high temperature system are reported by the authors to be crystalline.

There have been no reports of the direct electrochemical preparation of amorphous aluminum alloys. In addition it has not proved possible to prepare amorphous aluminum manganese alloys by the conventionally used rapid quenching technique.

OBJECT OF THE INVENTION

It is an object of the invention to improve the properties of protective coatings based on an alloy of e.g. group IIb and VIIb metals with aluminum, in particular to obtain a better surfaces quality, better microstructure, better adhesion and thinner coatings which provide more efficient use of the materials e.g. for galvanic corrosion protection and improved formability and weldability.

It is another object of the invention to provide a method for producing this coating which does not require high temperatures and is therefore less expensive and which does not create problems due to the formation of brittle intermetallic phases.

It is another object of the invention to provide a plating system which is stable during electrolysis and from which coatings can be plated without the risk of hydrogen embrittlement to the substrate being coated.

A further object of the invention is the provision of alloying components together with aluminum which may not be practically obtainable by the hot dipping process as is the case e.g. with aluminum-cadmium where the phase diagram shows no solubility between the respective solid and liquid states and in the case of aluminum-manganese where melt temperatures in excess of 850° C. are required to produce coatings with more than 10 w% manganese, and in excess of 1100° C. to produce coatings with more than 50 w% manganese. Such high temperatures will cause practical plant design problems and will be incompatible with many substrate materials.

A still further object of the invention is to provide a method which may under certain conditions lead to the formation of thermally metastable coatings in a non-equilibrium state, having e.g. amorphous structure.

SUMMARY OF INVENTION

The above objects of the invention are met by a protective coating as mentioned in the preamble characterized by the alloy components of the coating being present in a homogeneous, submicroscopic distribution obtained by electroplating of the alloy in an organic electrolyte. In a preferred embodiment of the invention the aromatic hydrocarbon is toluene and the above referred halides of the alloy components are chlorides. The electrical conductivity of the above electrolyte may be improved by addition of an alkali halide such as LiCl.

A coating according to the invention may comprise 5 to 95 w% of aluminum and 95 to 5 w% of zinc, cadmium or manganese.

The coating according to the invention has a finer microstructure than that produced by the hot dip process with grain sizes in the submicroscopic range, i.e. smaller than 1 micrometer. X-ray photos of the coating with magnification 4500 are shown in the drawings. This super fine structure is due to the random deposition of zinc and aluminum atoms.

Being a further object of the invention to provide a method for producing a corrosion protective coating as mentioned in the preamble, a method according to the invention may comprise the steps of (a) preparing an electrolyte comprising halides of the alloy components dissolved in an aromatic hydrocarbon; and (b) electroplating a cathodically polarized metal surface in the electrolyte according to "(a)"

The electrolyte as mentioned above may contain an alkali halide such as LiCl and the aromatic hydrocarbon may be toluene. The electrolyte used to carry out the method according to the invention may comprise 0.1 to 0.3 moles LiCl, 0.1 to 0.5 moles of $AlCl_3$ and one of 0.0003 to 0.003 moles of $ZnCl_2$ or 0.001 to 0.005 moles of $CdCl_2$ or 0.005 to 0.05 moles of $MnCl_2$ all per mole of toluene.

The method according to the invention may lead to the formation of corrosion protective coatings comprising 5 to 95 w% of Al and 95 to 5 w% of zinc, cadmium or manganese.

Coatings produced according to this invention may have a variety of different structures. While it is possible to obtain pure crystalline structures, it is also feasible to produce thermally metastable non-equilibrium structures such as amorphous coatings depending on the process parameters and compositions of the electrolyte and the deposit. Amorphous materials as well as the recently reported quasicrystalline phase (Physics Today, February 1985, page 17) are thermally metastable and revert to the crystalline phase on heating to a certain critical temperature. The relatively low temperatures (around 60° C.) of the organic electrolyte used to plate aluminum alloy coatings means that the thermally metastable phases which can be produced under the appropriate conditions of electrodeposition are stable under the conditions of preparation and do not convert to the more stable crystalline phase. The ability to produce amorphous coating structures is advantageous e.g. for applications where properties such as corrosion resistance are required, since it is well known that amorphous materials are significantly more resistant to corrosion than their crystalline equivalents. The use of these coatings in other areas, such as for chemical catalysts, decorative surface treatments, contact materials etc. may also be envisaged.

Finally, the invention is therefore directed to the use of a coating which is produced according to the above method for protecting metallic surfaces against corrosion.

DETAILED DESCRIPTION OF INVENTION

Coatings consisting of an alloy of aluminum with zinc, cadmium or manganese as a second component are produced by electroplating on cathodically polarized metal substrates in an electrolyte comprising toluene, $AlCl_3$ and a chloride of the mentioned second alloy component. With respect to the theory of electroplating in non-aqueous electrolytes voltametric measurements with the respective electrolytes containing zinc, cadmium or manganese were carried out in order to establish optimum operating parameters for the plating procedure and to determine the influence of those parameters on the composition of the deposit. As an example, one of these measurements was carried out in a solution of 0.33 moles of $AlCl_3$, 0.215 moles of LiCl and 0.01 mole $ZnCl_2$ for 1,00 mole of toluene. The voltametry showed a small cathodic wave at +160 mV vs the aluminum electrode which might correspond to the deposition of pure zinc. This first wave was followed by a composite wave from −100 to −260 mV with a more or less defined plateau from −260 to −800 mV. On the anodic side, if the applied cathodic potential was more positive than 0 mV, only one anodic peak was observed at +160 to +200 mV. If the applied cathodic potential was between −100 and −800 mV a large dissolution peak, which was the superposition of three peaks at +50 +150 and +200 mV was observed. The second alloy (+150 mV) was the predominant product in any case. The deposition of pure aluminum was observed only at potentials more negative than −1000 mV. The composition of the deposit was also studied by galvanic electrolyses at a micro cathode of platinum. At a current density lower than 15 $A/cm^2$ the deposit dissolution peak was observed from +100 mV.

At a current density between 15 and 40 $mA/cm^2$ the deposit dissolution was observed from +20 to +70 mV. At higher current densities a small peak of pure aluminum dissolution was observed at 0 mV.

At higher concentration at $ZnCl_2$ (6 mole %), the voltametry showed that up to −600 mV only pure zinc or at least rich zinc alloy could be obtained.

As a result of these measurement it can be concluded that in spite of the lack of an intermetallic compound between zinc and aluminum a Zn—Al alloy having a defined dissolution potential could be deposited at a defined potential, from an $AlCl_3$/aromatic hydrocarbon electrolyte.

The desired composition of the alloy deposit may be obtained by suitable choice of the bath composition and the plating conditions as illustrated in TABLE 1.

According to the results of the microstructural analysis the most homogeneous coating structures can be obtained with a ZnAl composition of 40 to 60 w% Zn.

According to these results the most useful composition of Zn—Al (less than or equal to 50 weight%) could be obtained with a bath containing about 1 mole% of $ZnCl_2$.

The hardness of the zinc aluminum deposit (10–30 w% Zn) was about 50 to 70 HV (Vickers Hardness) comparing to 40–50 HV for pure zinc, and about 30 HV for pure aluminum. The free corrosion potential of zinc-aluminum (10 to 30 w% Zn) in NaCl 350 gpl, was −1090 mV vs SCE. This value indicated that the galvanic protection power of Zn—Al should be better than for pure aluminum with a free corrosion potential of −650 to −950 mV.

SAMPLE PREPARATION AND CHARACTERIZATION

Three types of substrates were used, comprising mild steel, stainless steel and high strength steel.

The following bath composition and experimental conditions were used for Zn—Al (5/95 to 95/5) coatings:

LiCl: $AlCl_3$=0.65, $ZnCl_2$ concentration: 1.0 mole % vs $AlCl_3$ concentration, current density: 20 mA/cm$^2$. The samples were subjected to two different kinds of test, the first one was the saline spray test and the second were mechanical tests, which comprised the evaluation of the microhardness (Vickers), the ductility and the adhesion.

EXAMPLES

Example 1

In a glove-box, with a nitrogen atmosphere containing less than 10 ppm water, 8 portions of LiCl—$AlCl_3$—toluene solutions were prepared by mixing, at about 50° C., 0.215 moles of LiCl (9.125 g—Cerac 99.8%), 0.330 moles of $AlCl_3$ (44.055 g—Fluka 99%), and 1.0 mole of toluene (92 g—Merck "pro analysis").

Into one portion of solution, 0.020 moles of $ZnCl_2$ (2.728 g—Cerac 99.5%) was added in order to obtain a solution containing about 6 mole % $ZnCl_2$ vs $AlCl_3$ (solution A).

Afterwards, 7 plating solutions, with different initial concentrations of $ZnCl_2$, were prepared by adding a certain volume of solution A (4 to 20 ml) to each of the 7 other portions of LiCl—$AlCl_3$—toluene solution.

The electrolyses were carried out in a cylindrical glass cell, at 50°–60° C. The agitation was insured by a magnetic stirrer. Two Al anodes of dimension 2.5×6.0 cms were used. The cathode was a mild steel substrate of dimension 2.5.×6.0×0.1 cms. Before the deposition step, the mild steel substrate was polarized anodically in order to obtain a clean and activated surface. The respective anodic charges and current densities were in the range of 5–10 Asec/cm$^2$ and 5–10 mA/cm$^2$. After the anodisation step, the deposition of Zn—Al alloys was effected by inversion of the electrode polarity.

In order to avoid a strong modification of $ZnCl_2$ concentration in solution, the electrolyses are stopped after passage of a cathodic charge of 15 Asec/cm$^2$. A grey deposit of about 5–7 micrometers of thickness was obtained on the immersed surface of the substrate. The deposits were dissolved in 10% HCl and the composition was analyzed by atomic absorption.

The results listed in Table 2 show the influences of the initial concentration of $ZnCl_2$ in solution, and the current density on the deposit composition.

TABLE 1

| $ZnCl_2$ in solution (mole % vs $AlCl_3$) | $i_c$ (mA/cm$^2$) | Deposit composition (w %) Al | Zn |
|---|---|---|---|
| 0.84 | 20 | 34 | 66 |
| 0.80 | 20 | 42 | 58 |
| 0.84 | 30 | 56 | 44 |
| 0.77 | 30 | 56 | 44 |
| 0.70 | 30 | 56 | 44 |
| 0.31 | 30 | 66 | 34 |
| 0.17 | 30 | 84 | 16 |

The coating adherence was tested by bending tests, no cracks nor peeling of the coatings were observed. The ductility of the coatings was estimated following the ASTM-B489 standard, all the coatings with compositions listed in Table 1 showed experimental elongations of 100% or higher.

The microhardness (Vickers) of the coatings, which increases with the contents of Zn, was in the range of 44 to 50 HV.

Example 2

Three solutions of $ZnCl_2$, LiCl, $AlCl_3$ and toluene, with $ZnCl_2$ concentrations of 1.0, 0.5 and 0.3 mole % versus $AlCl_3$ concentration were prepared as in example 1.

The electrolyses were carried out under similar conditions as described in example 1. The current density was in the range of 20 to 30 mA/cm$^2$, and were chosen following the initial concentration of $ZnCl_2$ in order to obtain ZnAl deposits containing about 30 to 80% of Zn. Four samples of ZnAl coated mild steel of 8–10 micrometers thickness, with different deposit compositions were obtained.

The metallographic samples of these coatings were prepared and the microstructure of the deposits was examined by making the mapping analysis of Zn and of Al by the SEM method.

Example 3

Four solutions of $ZnCl_2$, LiCl, $AlCl_3$ and toluene were prepared as in example 1.

The electrolyses were carried out under the same conditions as described in example 1. Two Al anodes, and two new Zn anodes were used for each electrolysis. Two rectifiers were used in opposition in order to adjust the partial currents through the Al and Zn anodes. The cathodic charges were calculated in order to obtain a quantity of Zn deposited, under the form of ZnAl alloys, corresponding to about 50% of the total quantity of Zn in solution. The mass balance of $ZnCl_2$ in solution is determined by the weight loss of Zn anodes, by the composition analyses of the deposits and the electrolyte before and after electrolysis.

The results listed in Table 2 show the influence of the anodic current density and the current ratio between Al and Zn anodes (i(Zn):i(Al)) on the current efficiency of the Zn dissolution and the $ZnCl_2$ mass balance.

TABLE 2

| $i_a$ (mA/cm²) | i(Zn)/i(Al) | Init. Zn (mole %) | Deposit Zn (w %) | CE diss. Zn(%) | ΔZn (sol.) (%) |
|---|---|---|---|---|---|
| 20 | 0.25 | 0.98 | 66 | 118 | −22.4 |
| 30 | 0.25 | 0.84 | 44 | 111 | −17.9 |
| 30 | 0.25 | 0.84 | 44 | 96 | −26.2 |
| 20 | 0.43 | 0.80 | 58 | 103 | 0 |

Note:
(1) The current efficiency of the anodic dissolution of Zn higher than 100% may be due to the reaction: $Zn + 2H^+ \rightarrow Zn^{2+} + H_2$
(2) ΔZn (solution) = $(Zn_{initial} + Zn_{dissolved}) - (Zn_{deposited} + Zn_{final})$
ΔZn is calculated relative to the initial concentration of $ZnCl_2$ in solution.
The negative value of ΔZn is due to the concentration of $Zn^{2+}$ onto the back of the Al anodes following the reactions: $2Zn^{2+} + 2Al \rightarrow 2Al^{3+} + 3Zn$.

Example 4

A solution $CdCl_2$: LiCl; $AlCl_3$: toluene of composition (in mole units) 0.003: 0.215: 0.330: 1.0 was prepared by mixing 0.550 g $CdCl_2$ (Cerac—99.5%), 9.125 g LiCl (Cerac—99.8%), 44.055 g $AlCl_3$ (Fluka—99%) and 92 g toluene (Merck—"pro analysis").

The electrolysis was carried out in a cylindrical glass cell as described in example 1. Two Al anodes were used. The cathode was a mild steel substrate of dimensions 2.5×6.0×0.1 cms. The anodisation of the substrate was carried out at 7.5 mA/cm² with a charge of 5 Asec/cm². The subsequent deposition was effected at 20 mA/cm². After the passage of a cathodic charge corresponding to 35 Asec/cm², a "grey-silver" deposit of about 20 micrometer thickness was obtained on the immersed surface of the substrate. One part of the coating was dissolved in 10% HCl, and the qualitative analysis of the resulting solution showed the presence of Cd and Al.

The coating adherence onto mild steel substrate was tested and proved by the bending test. The coating ductility, estimated following the ASTM-B489 standard, is about 100% of elongation. The micro hardness (Vickers) is about 54 HV. One sample of CdAl coated mild steel of dimensions 2.5×5.0×0.1 cms was heat treated in air, successively at 400°, 500° and 600° C. during 1 hour at each temperature, and no destruction of the coating by Cd fusion was observed, only a surface oxidation of Al.

Example 5

A solution $MnCl_2$: LiCl; $AlCl_3$: toluene of the composition (mole unit) 0.010: 0.215: 0.330: 1.0 was prepared by mixing 1.258 g $MnCl_2$ (Cerac—99.8%), 9.125 g LiCl (Cerac—99.8%), 44.055 g $AlCl_3$ (Fluka—99%) and 92 g toluene (Merck—"pro analysis").

The electrolysis was carried out in a glass cell as described in example 1. Two Al anodes were used. The cathode was a mild steel substrate of dimensions 2.5×6.0×0.1 cms. The anodisation of the substrate was effected at 10 mA/cm² with a charge of 5 Asec/cm². After the passage of a cathodic charge corresponding to 35 Asec/cm², a dark grey deposit of about 10 micrometers was obtained on the immersed surface of the substrate. The qualitative analysis of the coating, dissolved in HCl 10%, showed the presence of Mn and Al.

The coating adherence was tested and proved by the bending tests. The coating ductility estimated following the ASTM-B489 standard, was between 30 and 50% of elongation. The micro hardness (Vickers) of the coating was about 250 HV.

Example 6

Four samples of Zn—Al, one sample of Cd—Al and one sample of Mn—Al coated mild steel (dimensions 2.5×6.0×0.1 cms) were prepared following the conditions described in examples 1, 4 and 5. The mild steel substrate in all cases were cleaned and activated by anodisation in the same plating bath, at 5 mA/cm², with an anodic charge corresponding to 5 Asec/cm². Afterwards, the samples were submitted to the saline spray test, without any post-treatment. The results are listed in Table 3.

TABLE 3

| Characteristics | | | | Performances | | |
|---|---|---|---|---|---|---|
| Type | Comp. (w %) | Thickness (μm) | Initial Potent. (mV)* | Test Time (hrs.) | Pot. (mV)* | Comments |
| Zn/Al | 18–82 | 10 | −1170 | 510 | −340 | (A) red rust at 420 hrs |
| Zn/Al | 35–65 | 10 | −1140 | 1040 | −450 | (A) red rust at 635 hrs |
| Zn/Al | 45–55 | 10 | −1150 | 1040 | −370 | (A) red rust at 635 hrs |
| Zn/Al | 60–40 | 10 | −1150 | 1135 | −1040 | (A) no red rust |
| Cd/Al | | 10 | −840 | 385 | −830 | (B) no red rust |
| Mn/Al | | 10 | −895 | 580 | −620 | (B) no red rust |
| | | | | 1444 | −629 | no red rust |
| | | | | 2668 | −578 | no red rust |
| | | | | 2860 | −540 | 60% red rust |

*Saturated NaCl, SCE Reference Electrode
(A) Edges exposed - (B) Edges covered, coating scribed.

Example 7

Four samples of ZnAl coated mild steel (dimensions 2.5×6.0×0.1 cms) were prepared following the conditions described in example 1. The mild steel substrate in all cases were sandblasted, cleaned in water, activated in HCl 30% for 5 minutes, and rinsed in water, and acetone. Afterwards, the dried substrates were introduced into the glove-box. The depositions were made immediately, without any anodisation. The adherence of the coating was successfully tested by bending tests.

The samples were submitted to the saline spray test as described in example 6. The results are listed on the Table 4.

TABLE 4

| Characteristics | | | | Performances | | |
|---|---|---|---|---|---|---|
| Type | Comp. (w %) | Thickness (μm) | Initial Potent. (mV)* | Test Time (hrs.) | Pot. (mV)* | Comments |
| ZnAl | 10–90 | 10 | −1085 | 72 | | (B) no red rust |
| ZnAl | 30–70 | 5 | −1150 | 192 | | (B) no red rust |
| ZnAl | 40–60 | 5 | −1150 | 192 | | red rust at 72 hrs. |
| ZnAl | 50–50 | 10 | −1120 | 192 | | red rust at 92 hrs. |

*saturated NaCl - SCE Reference electrode
(B) Edges covered, coating scribed.

Example 8

A solution of $MnCl_2$, LiCl and $AlCl_3$ in toluene was prepared from 10 g $MnCl_2$ (Cerac—99.8%), 30.6 g LiCl (Cerac—99.8%), 160 g $AlCl_3$ (Fluka—99%) and 330 g toluene (Merck—"pro analysis").

The electrolysis was carried out in a glass cell as described in example 1. After passage of a cathodic charge of 750 Asec a deposit of about 4–5 micrometers thickness was obtained on the steel substrate. Elemental analysis of the coating in a Scanning Electron Microscope showed it to contain about 20 w% Mn and 80 w% Al.

A section of the coating was removed from the steel substrate and investigated by Transmission Electron Microscopy. The transmission electron diffraction pattern obtained showed the coating to be amorphous. On heating the material the electron diffraction pattern changed and a spot pattern was obtained characteristic of the crystalline phase $Al_6Mn$. This confirms the metastable nature of the coating as deposited.

Example 9

A solution of $MnCl_2$, LiCl and $AlCl_3$ in toluene was prepared from 16.8 g $MnCl_2$ (Cerac—99.8%), 33.9 g LiCl (Cerac—99.8%), 177.8 g $AlCl_3$ (Fluka—99%) and 368.6 g toluene (Merck—"pro analysis").

The electrolysis was carried out in a glass cell as described in example 1. After passage of a cathodic charge of 1300 Asec at a current density of 20 $mA/cm_2$ a deposit of about 22 micrometers thickness was obtained on the steel substrate. A section was cut from the sample and the deposit was dissolved in 20% HCl. The resulting solution was analyzed by atomic absorption spectroscopy. The results obtained showed that the coating contained about 35 w% Mn and 65 w% Al.

The remaining piece of the coated sample was subjected to X-ray diffraction analysis. The X-ray diffraction pattern obtained with Cu $K_{alpha}$ radiation consisted of a broad peak spread over the 2 theta range of 35°–50° centered at 42.6°. On heating the sample for five minutes at 400° C. in argon the broad peak in the X-ray diffraction pattern was resolved into sharp diffraction lines, illustrating the thermally metastable nature of the deposited coating.

What is claimed is:

1. A metallic substrate coated with a coating of an aluminum-manganese alloy, characterized in that the coating is a homogeneous, amorphous alloy of aluminum-manganese containing 95 to 5 w% manganese and a balance of aluminum, and having a grain size smaller than 1 micrometer, said homogeneous, amorphous aluminum-manganese alloy coating having been obtained by electroplating onto the substrate from an essentially water-free electrolyte comprising 0.1–0.3 mole of an alkali halide, 0.1 to 0.5 mole of an aluminum halide and 0.005–0.05 mole of a manganese halide per mole of an aromatic hydrocarbon solvent, said homogeneous amorphous aluminum-manganese alloy coating having a thermally metastable state which is stable under the conditions of preparation but can be converted to a crystalline state by heating to a critical temperature.

2. The coated substrate of claim 1, wherein the homogenous, amorphous alloy coating contains from about 20 w% Mn 80 w% Al to about 35 w% Mn 65 w% Al.

3. A method of electroplating a metallic substrate with a coating of an aluminum-manganese alloy, comprising the steps of:

(a) preparing an essentially water-free electrolyte comprising 0.1–0.3 mole of an alkali halide, 0.1 to 0.5 mole of an aluminum halide and 0.005 to 0.5 mole of a manganese halide per mole of an aromatic hydrocarbon solvent and (b) cathodically polarizing the metallic substrate in the electrolyte to deposit a coating of a homogeneous, amorphous alloy of aluminum-manganese containing 95 to 5 w% manganese and a balance of aluminum, and having a grain size smaller than 1 micrometer, said homogeneous, amorphous aluminum-manganese alloy coating having a thermally metastable state which is stable under the conditions of preparation but can be converted to a crystalline state by heating to a critical temperature.

4. The method of claim 3, wherein said electrolyte preparation provides 0.1–0.3 mole of LiCl, 0.1 to 0.5 mole of $AlCl_3$ and 0.005 to 0.5 mole of $MnCl_2$ per mole of toluene.

5. The method of claim 4, wherein the resulting homogeneous, amorphous alloy contains from about 20 w% Mn 80 w% Al to about 35 w% Mn 65 w% Al.

* * * * *